United States Patent [19]

Casciotti et al.

[11] 4,020,540

[45] May 3, 1977

[54] APPLICATOR TOOL

[75] Inventors: Albert Casciotti, Hershey; Leslie Carl Hall, Jr., Camp Hill, both of Pa.

[73] Assignee: AMP Incorporated, Harrisburg, Pa.

[22] Filed: July 27, 1976

[21] Appl. No.: 709,158

Related U.S. Application Data

[63] Continuation-in-part of Ser. No. 661,905, Feb. 26, 1976, abandoned.

[52] U.S. Cl. ..... 29/749; 29/751; 29/753

[51] Int. Cl.[2] ..... H01R 43/04

[58] Field of Search ... 29/203 MW, 203 C, 203 DT, 29/203 D, 203 H, 203 HT, 203 P, 628

[56] References Cited

UNITED STATES PATENTS

| | | | |
|---|---|---|---|
| 3,866,297 | 2/1975 | Aldridge | 29/203 MW |
| 3,938,246 | 2/1976 | Over et al. | 29/203 MW |
| 3,956,811 | 5/1976 | Munshower | 29/203 DT |

*Primary Examiner*—Carl E. Hall
*Attorney, Agent, or Firm*—Russell J. Egan

[57] ABSTRACT

An improved connector applicator tool is disclosed for applying multi-contact electrical connectors into flat cables formed of a plurality of closely spaced parallel conductors. The tool is a bench mounted applicator which is adjustable to accommodate preformed multi-conductor flat cables of conventional dimensions and which also has an embodiment which will accommodate a cable formed by a plurality of discrete conductors. The tool includes means to positively clamp the multi-conductor flat cable so as to be properly and accurately aligned with the tooling assembly which applies the connector to the cable. The tooling assembly is adaptable to accommodate a wide range of contact configurations and connector sizes. The actuation of the tool for the application step can be accomplished by manual means or by powered actuation, such as fluid drive means. The discrete conductor embodiment also includes means for effecting a severing of the conductors immediately adjacent the applied connector. The subject assembly tool can be used to apply connectors to terminate cables as well as to create a daisy chain of a plurality of connectors mounted onto a continuous run of cable.

24 Claims, 17 Drawing Figures

Fig. 3
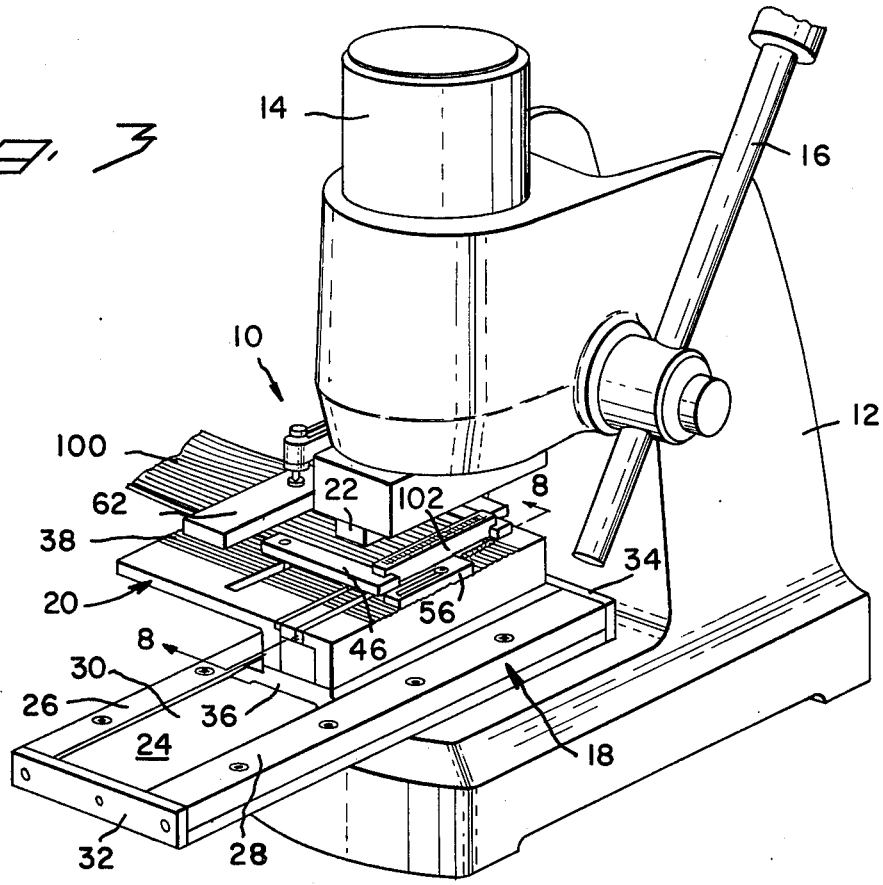
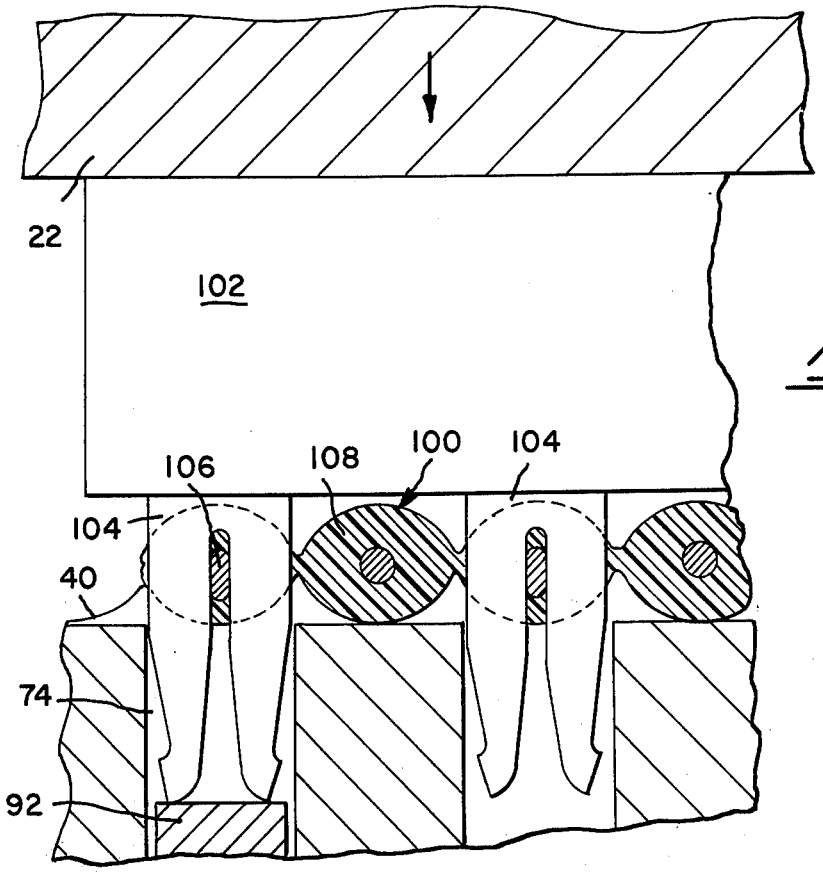
Fig. 8

APPLICATOR TOOL

CROSS-REFERENCE TO RELATED APPLICATIONS

The present application is a continuation-in-part of our application Ser. No. 661,905 filed Feb. 26, 1976, now abandoned.

BACKGROUND OF THE INVENTION

1. The Field Of the Invention

The present invention relates to an applicator tool for applying electrical connectors onto multi-conductor flat electrical cable and in particular to an applicator which will apply connectors having a plurality of closely spaced insulation piercing contacts onto flat cable having a like plurality of closely spaced insulated conductors. 2. The Prior Art The present invention is intended for use in applying connectors of the type disclosed in U.S. Pat. No. 3,820,055 onto multi-conductor flat cables. Heretofore connectors of this type have been applied in a manner as shown in FIG. 7 of the patent. However, these previous techniques for applying connectors have had certain drawbacks in that they were often rather slow, were open to error in placement of the cable, and could not be readily shifted to accommodate various width cables and various sizes of connectors.

SUMMARY OF THE INVENTION

The present invention comprises a bench mounted press frame assembly supporting an applicator tooling assembly. The press frame assembly includes a generally C-shaped frame having a tool driving ram and ram actuating means on the upper portion of the frame and tooling assembly guide rails on the lower portion of the frame. The tooling assembly includes a base plate assembly having a sliding base mounted on the guide rails with a fluted base plate mounted on the sliding base and provided with adjustable and stationary spaced, parallel, cable guide means, an adjustable cable end stop means, and clamping means adapted to secure a cable on the fluted base plate. The clamping means may also be fluted to provide cable registration while obviating the need for the fixed and adjustable cable guide means. The base plate assembly also includes a crimping insert assembly comprising a stacked array of at least two crimping insert members, each defining a plurality of parallel, spaced contact receiving recesses and together defining a stripper assembly cavity. A stripper assembly is mounted in the stripper assembly cavity and includes at least two stripper blades, a spacer, a base supporting the blades and spacer and spring bias means. Portions of the stripper blades lie within the contact receiving recesses and serve to drive the contacts from the recesses when the application force of the ram is removed. The base plate assembly also may be provided with optical means for visually inspecting both the alignment of the conductors in the flutes and the contacts with the conductors.

It is therefore an object of the present invention to produce an electrical connector applicator tool having means to positively position a multi-conductor cable for accurate application of a multi-contact connector to the cable at the end of the cable or any point intermediate the ends of the cable.

It is another object of the present invention to produce an electrical connector applicator tool which can be adjusted to accept a wide range of dimensions of flat multi-conductor cable, including cables formed of discrete conductors, as well as a wide range of connector sizes and contact configurations.

It is still another object of the present invention to produce an electrical connector applicator tool which can be used to apply electrical connectors to multi-conductor flat cables by operators having only minimal amounts of skill and training.

It is yet another object of the present invention to produce an electrical connector applicator tool which makes use of the operator's visual and tactile senses to assure alignment of the contacts with the appropriate conductors before insertion thereby substantially reducing losses due to faulty connections.

It is a further object of the present invention to produce an electrical connector applicator tool which can be readily and economically produced.

The means for accomplishing the foregoing objects and other advantages of the present invention will become apparent from the following detailed description taken with reference to the accompanying drawings.

BRIEF DESCRIPTION OF THE DRAWINGS

FIG. 3 is a perspective view, similar to FIGS. 1 and 2, with the cable and connector in place on the base plate assembly which is positioned beneath the ram for application of the connector to the cable;

FIG. 8 is a fragmentary vertical section taken along line 8—8 of FIG. 3 showing contacts of the connector engaging conductors of the cable;

DETAILED DESCRIPTION OF THE PREFERRED EMBODIMENTS

Figure 1:
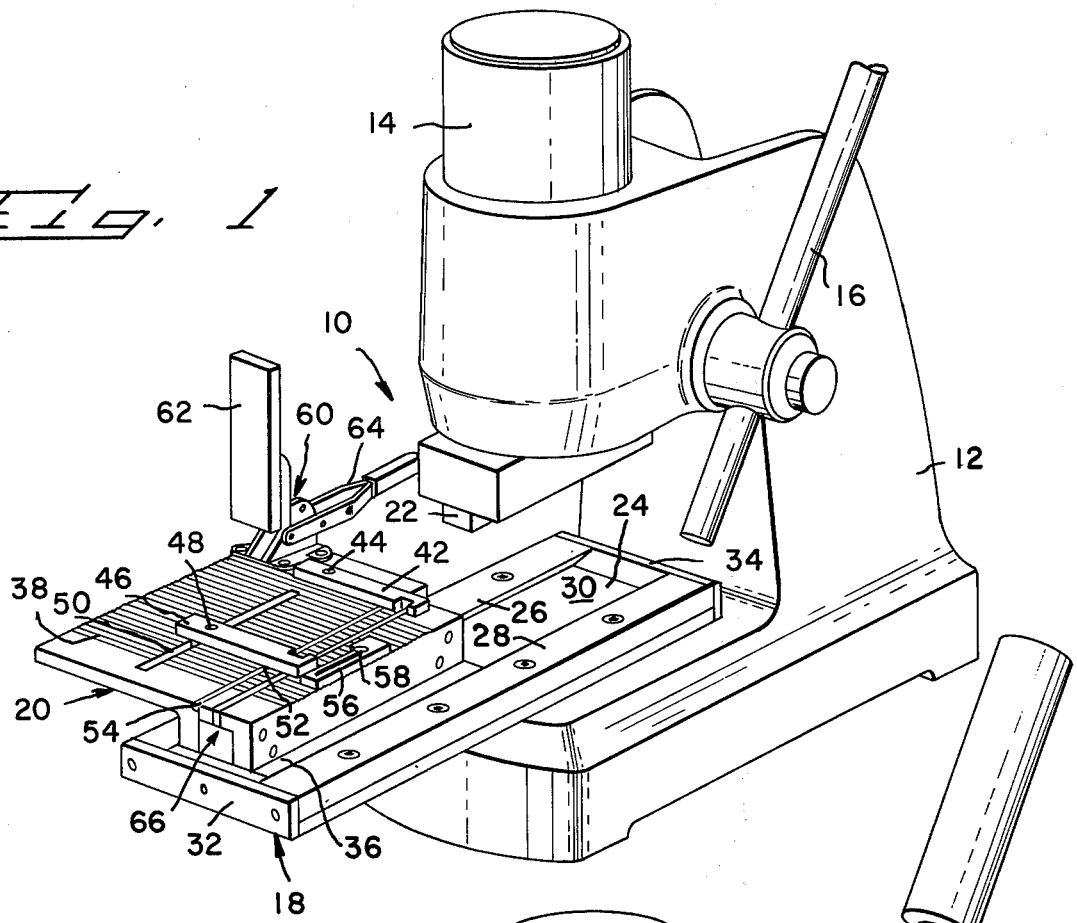
FIG. 1 is a perspective view of the subject applicator tool ready to receive a cable and a connector.
Figure 2:
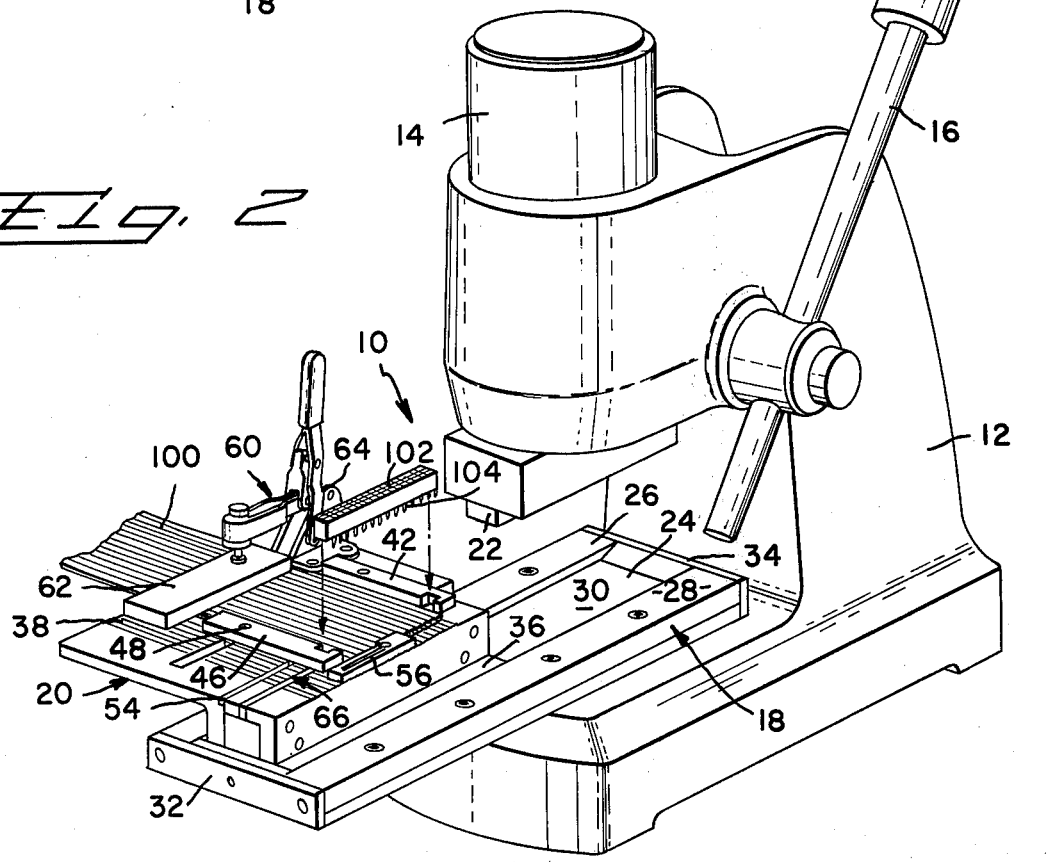
FIG. 2 is a perspective view, similar to FIG. 1, showing a cable in place and a connector exploded above the cable.

The entire electrical connector applicator tool according to the present invention is shown in FIGS. 1 to 3. The subject applicator tool 10 includes a substantially C-shaped frame 12, an applicator ram 14 mounted for vertical movement in the upper portion of the frame, ram actuation means 16, guide rail means 18 fixed to the lower portion of the frame, and a first base plate assembly 20 slidably mounted on the guide rail means 18. The frame 12 has been shown in a nonlimiting configuration suitable for bench mounting of the subject tool. Clearly other suitably shaped frames could be substituted for the one shown. The ram actuation means 16 has been shown as a lever which would work conventional rack and pinion, or other suitable gearing (not shown) to drive the ram 14. The actuation means shown could be replaced by any suitable powered drive means, such as a fluid actuated motor, without departing from the scope of the subject invention. An upper tool member 22 is detachably mounted on the lower end of the ram 14.

The guide rail assembly 18 includes a base plate 24, a pair of guide rails 26, 28 fixed to plate 24 in parallel spaced fashion defining a guide channel 30 therebetween, and front and rear end stops 32, 34, respectively. The base plate assembly 20 includes a sliding base member 36 which is mounted for sliding movement in the channel 30 between a position displaced from beneath the ram 14 and tool member 22, as shown in FIGS. 1 and 2, and a position immediately beneath the ram 14 and tool member 22, as shown in FIG. 3. The base plate assembly 20 includes a fluted base plate 38 secured to the sliding base member 36 with the flutes 40 extending normal to the direction of sliding movement of the assembly. A fixed cable guide 42 is secured to a first side of the base plate 38 by fastener means 44 and a movable cable guide 46 is attached to the base plate 38 by fastener means 48 mounted in slot 50. The movable cable guide includes a finger 52 which slides in groove 54 to keep the movable cable guide 46 parallel to the fixed cable guide 42. A removable and adjustable cable end stop 56 is attached to the base plate 38 by fastener means 58. A cable clamp assembly 60 is mounted on the base plate 38 and includes a clamping pad 62 and a clamping toggle 64 for moving the pad between the open and clamping positions shown in FIGS. 1 and 2, respectively. It should be noted that the pad 62 can be provided with a plurality of flutes which would correspond to and mate with the flutes 40 of the base plate 38.

Figure 4:
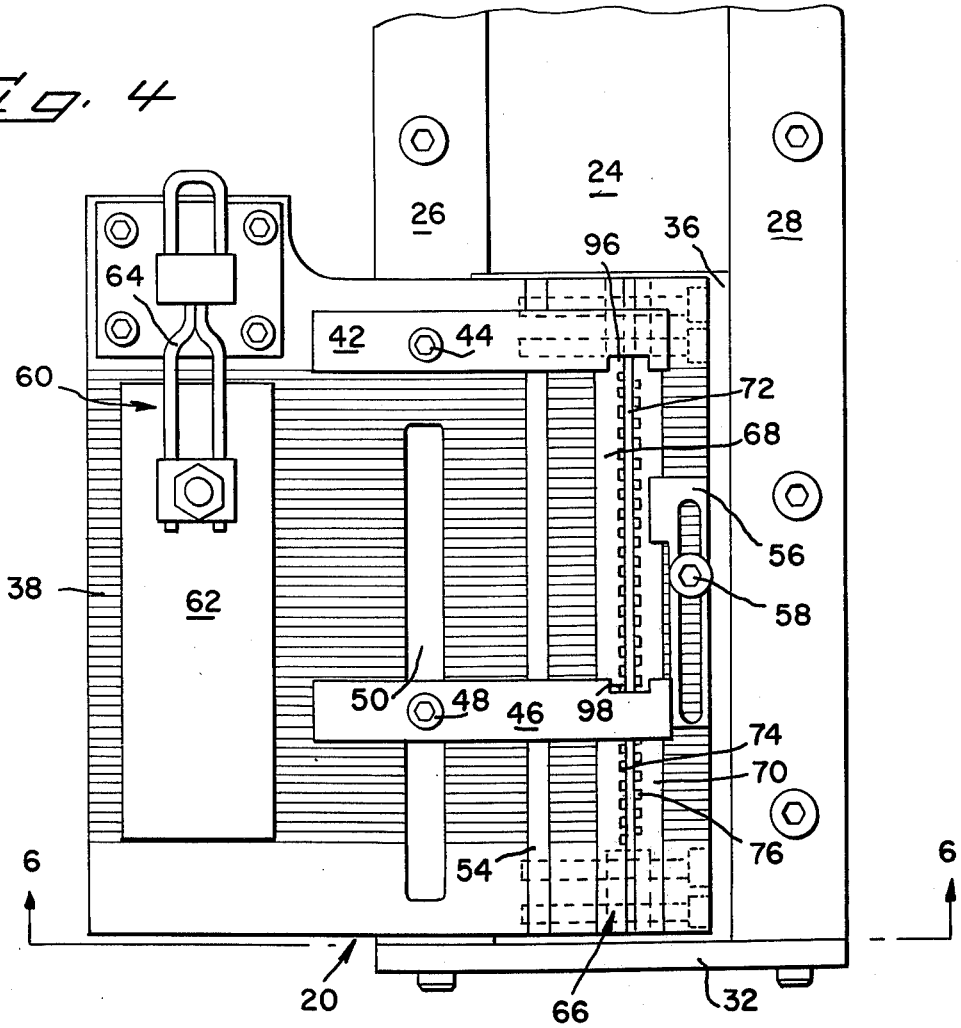
FIG. 4 is a plan view of a first embodiment of the base plate assembly.
Figure 5:
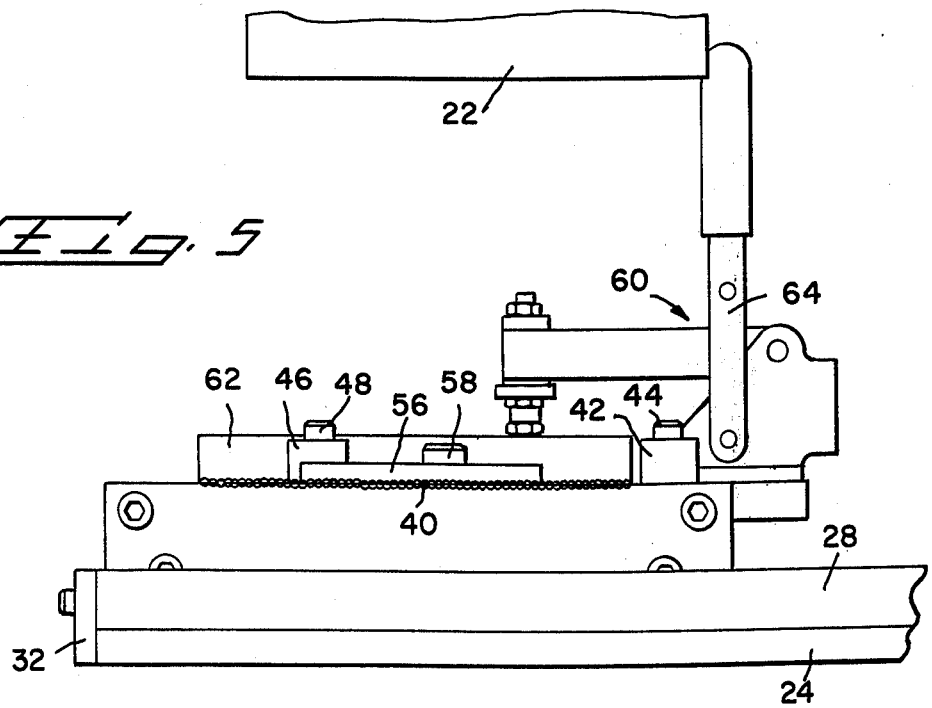
FIG. 5 is an end elevation of the base plate assembly of FIG. 4.
Figure 6:
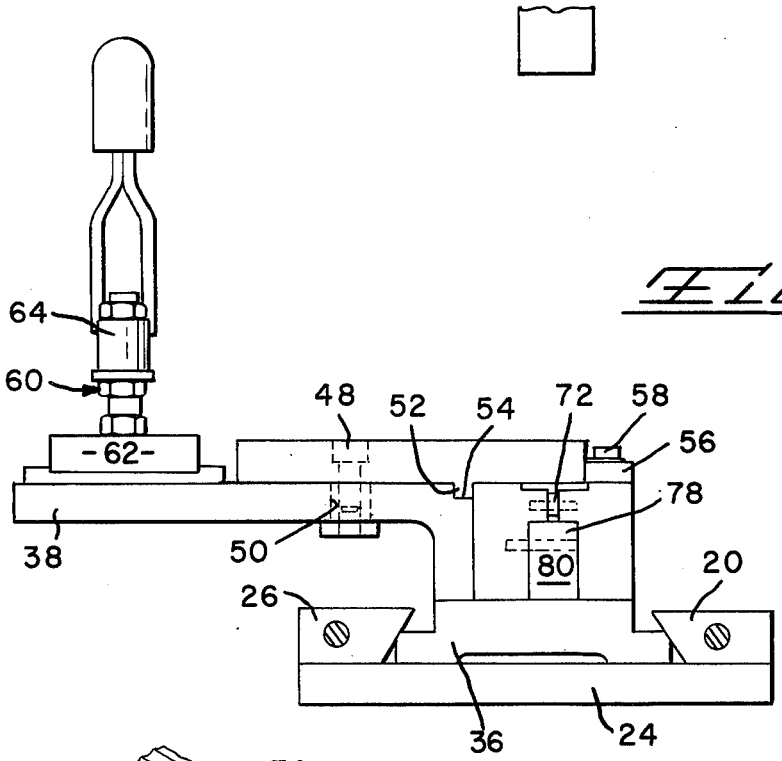
FIG. 6 is a side elevation of the base plate assembly of FIG. 4.
Figure 7:
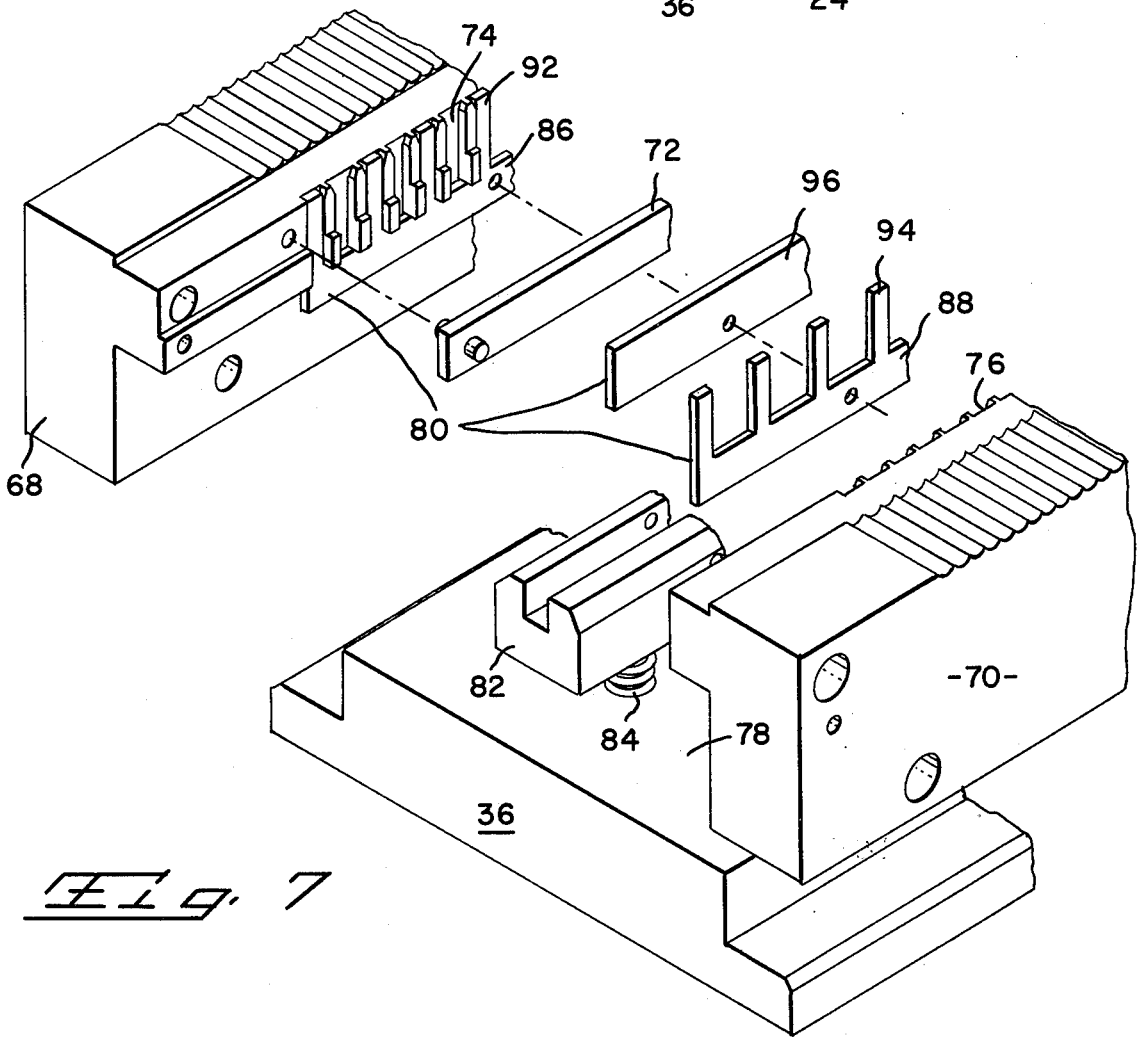
FIG. 7 is an enlarged, exploded perspective view of one end of the crimp assembly.

A crimping insert assembly 66 is also secured in the base plate assembly and includes first and second crimping members 68, 70 mounted on opposite sides of a spacing bar 72. Each of the members 68, 70 defines a plurality of parallel spaced apart contact receiving cavities 74, 76 and together define a stripper assembly cavity 78. A stripper assembly 80 is mounted in the cavity 78 and includes a stripper blade base 82 resiliently supported on the sliding base 36 by spring means 84 and at least two stripper blade members 86, 88 mounted on base 82 separated by a spacer bar 90. Each member, 86, 88 has a plurality to blades 92, 94 extending therefrom to lie within alternate cavities 74, 76 respectively. It will be noted from FIG. 4 that the fixed cable guide 42 and the movable cable guide 46 are provided with connector receiving recesses 96, 98, respectively, which are substantially aligned with ends of the crimp insert assembly 66.

The crimp insert assembly 66 has been shown, for purposes of clarity in explaining its function and operation, as a multi-part assembly attached to the sliding base member 36 and the fluted base plate 38. It is, of course, within the scope of the present invention to make the separate parts of the assembly integral with other components of the base plate assembly 20. For example, the fluted base plate 38, crimp members 68, 70 and spacer bar 72 could be formed as a unitary member.

In order to apply a connector to a cable with the subject tool, it is first necessary to determine what size of connector is to be applied and the configuration of the contacts in the connector. A typical connector is shown in U.S. Pat. No. 3,820,055. The applicable upper tool member 22 must be mounted on the lower end of the ram 14 with a corresponding crimp insert assembly 66 being secured in the base plate assembly 20. It also must be determined what type of cable is to be used, namely whether it will be performed cable or discrete wires assembled to form a cable. The appropriate base plate assembly 20 is placed in the channel 30 and the adjustable cable guide 46 and end stop 56 adjusted for proper positioning of the cable with respect to the crimp insert assembly 66 in base plate 38. The base plate assembly 20 should be checked by sliding it to position beneath the ram and see that the upper tool member 22 mates properly with the connector 102 so that the contacts 104 enter the proper cavities 74, 76. It may be necessary at this point to effect minor adjustments to assure proper alignment. When the tool has been adjusted for the proper cable 100 and connector 102, it is ready for use and may be used by opening the cable clamp 60, positioning a cable 100 between the guides 42, 46 and against the stop 56, and securing the cable 100 against the base plate 38 by closing the clamp 60. Because the base plate 38 is provided with flutes 40, each conductor 106 of the cable 100 will lie in an appropriate flute 40, see FIG. 8, and remain parallel with each other and with the cable guides. The conductors 106 will also be aligned properly with the contacts 104 in the connector 102, when it is placed between the connector receiving recesses 96, 98, and with the appropriate contact cavities 74, 76 in the crimping insert assembly 66. The connector 102 is placed with its ends in recesses 96, 98 and the base plate assembly 20 is moved rearwardly until it abuts against the rear stop 34. The ram 14 is then positioned directly above connector 102 and is actuated until the connector is bottomed against the cable by the ram, as shown in FIGS. 8 and 9, with the stripper assembly 80 pressed against spring means 84.

Figure 9:
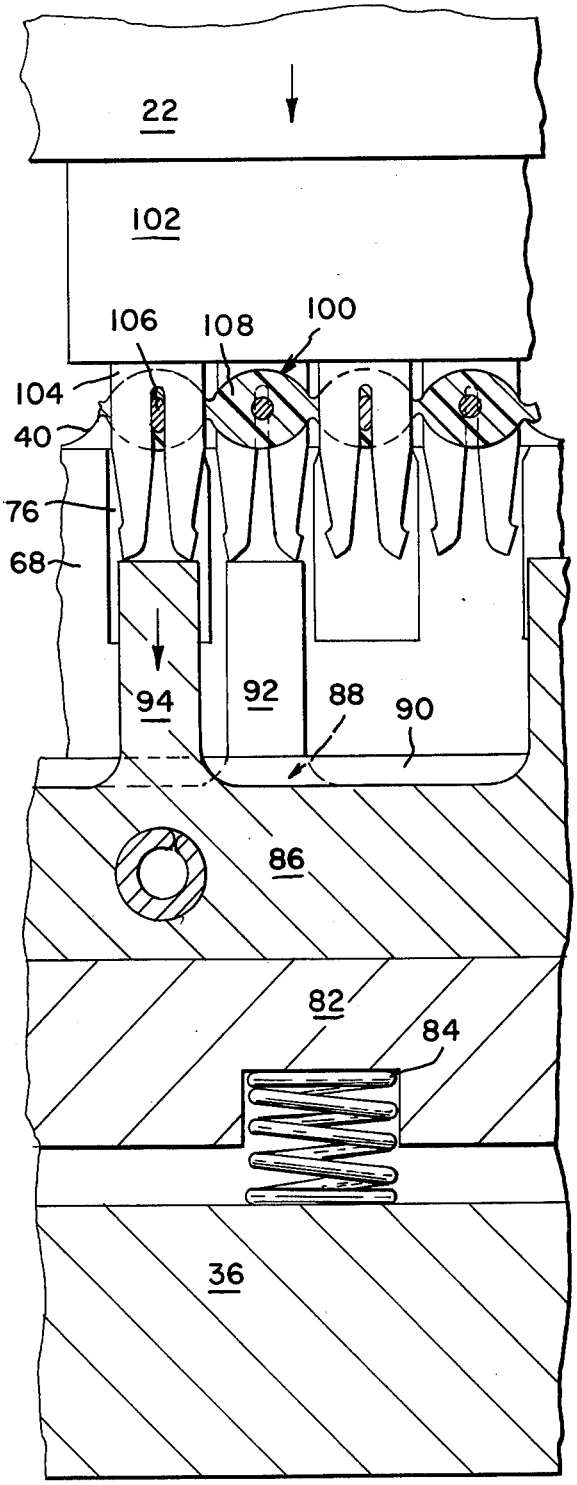
FIGS. 9 and 10 are enlarged, fragmentary, diagrammatic, vertical sections taken along line 8—8 of FIG. 8 showing the operation of the crimp assembly portion of the subject tool.
Figure 10:
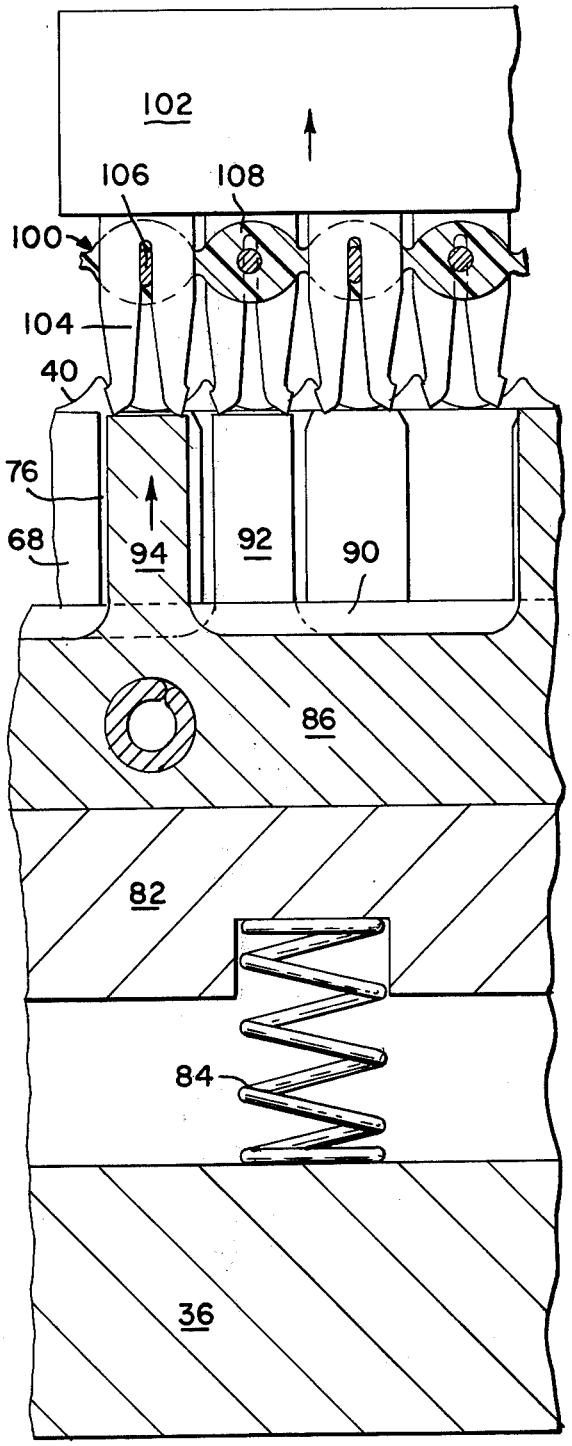

Turning now to FIGS. 7 to 10, these Figures illustrate the operation of the tool during the above-described application sequence. In FIG. 8 to 10 the upper tooling 22 is shown acting against the connector 102 to drive the contacts 104 through the insulation 108 of cable 100 to engage the conductors 106 embedded therein. The legs 110 of the contacts 104 extend into contact cavities 74, 76 of the crimping insert members 68, 70 with the cavities guiding and restraining the legs 110 of the contacts 104 against undue spreading. At least some of the contacts 104 strike against spring biased stripper blades 92, 94 to depress the stripper assembly 80 against the bias of spring means 84.

The ram 14 is returned to its initial position and the base plate assembly 20 is moved forward from beneath the ram 14 to the position shown in FIG. 2. As the ram 14 is returned to its initial position, the stripper blades 86, 88 are driven upwardly by the force of spring means 84 to drive the contacts 104 from the respective cavities 74, 76 of the crimp members 68, 70. The clamp 60 is released and the cable 100, with the connector 102 applied thereto, is removed. Engagement of the contacts 104 with the conductors 106 of the cable 100 can now be visually inspected to insure there are no bent or misaligned contacts and that all connections have been properly made. An appropriate size cover (not shown) similar to cover 16 of U.S. Pat. No. 3,820,055, is placed into the recess 96, 98 with locking legs of the cover directed away from the base plate for insertion into locking slots of the connector housing. The cable is again secured to the base plate 38 with the clamp 60. The base plate assembly 20 is again moved to the rear until it is positioned beneath the ram 14 and the ram 14 is actuated to drive the connector 102 into the cover to make a locking engagement therebetween.

Figure 11:
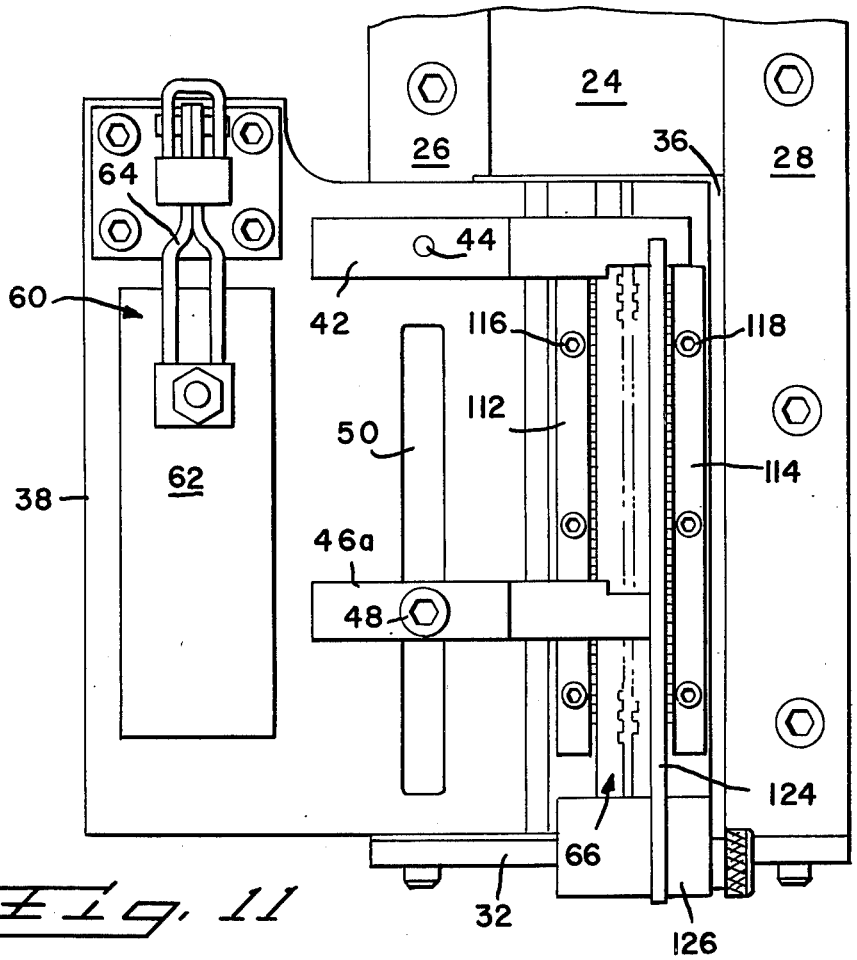
FIG. 11 is a plan view of a second embodiment of the base plate assembly for use in the subject invention.
Figure 12:
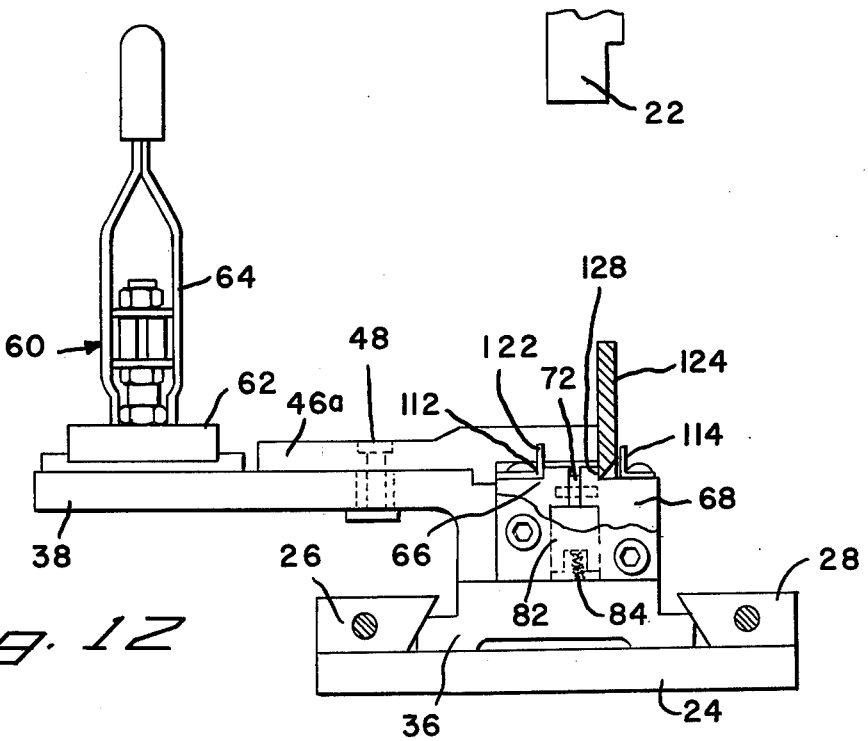
FIG. 12 is an end elevation of the base plate assembly of FIG. 11.
Figure 13:
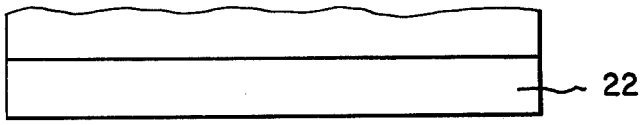
FIG. 13 is a side elevation of the base plate assembly of FIG. 11.
Figure 13:
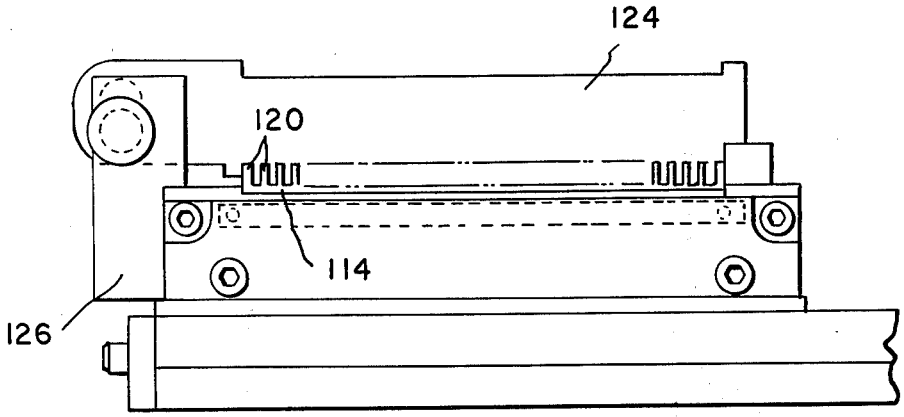

The second embodiment of the base plate assembly is shown in FIGS. 10 to 12 and only those portions which are structurally different from the first embodiment will be described in detail. The parts that are common will be identified by like reference numerals. Since this embodiment is intended for use with discrete wires, it is provided with first and second parallel spaced comb members 112, 114 which are fixed to the base plate 38 on opposite sides of the crimping insert assembly 66 by securing means 116, 118. The teeth 120 of the combs are positioned so that conductors (not shown) laced therebetween will be juxtapositioned with respect to the contact receiving cavities 74, 76 of the crimp insert assembly 66. The movable cable guide **46*a* is provided with an additional slot 122 which allows the guide to pass over comb 112. This embodiment is also provided with a shearing blade 124 which is pivotally mounted in a housing 126 fixed to the base plate 38. The shear blade 124 enters groove 128 to cut the individual conductors immediately between the connector 102 and the comb member 114.**

Figure 14:
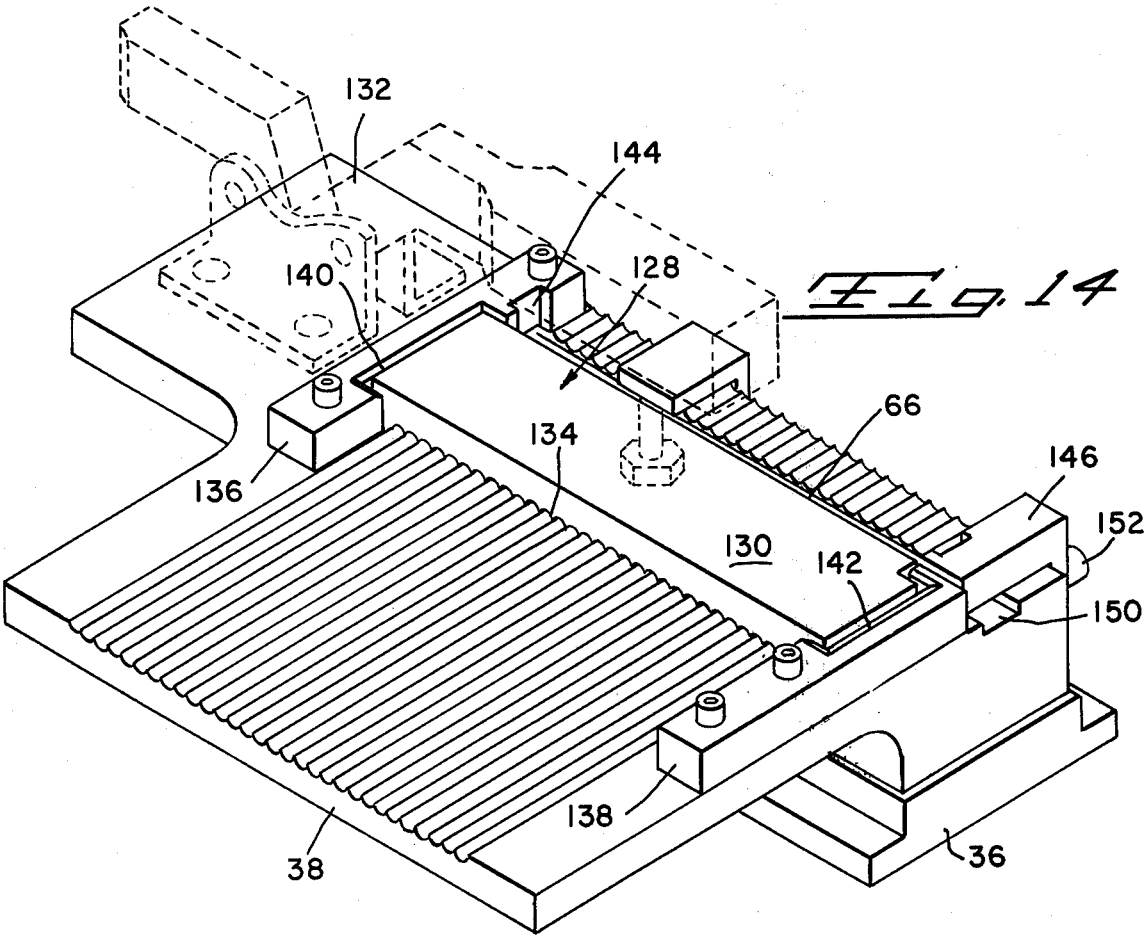
FIG. 14 is a perspective view of a third embodiment of the base plate assembly for use in the subject invention.
Figure 15:
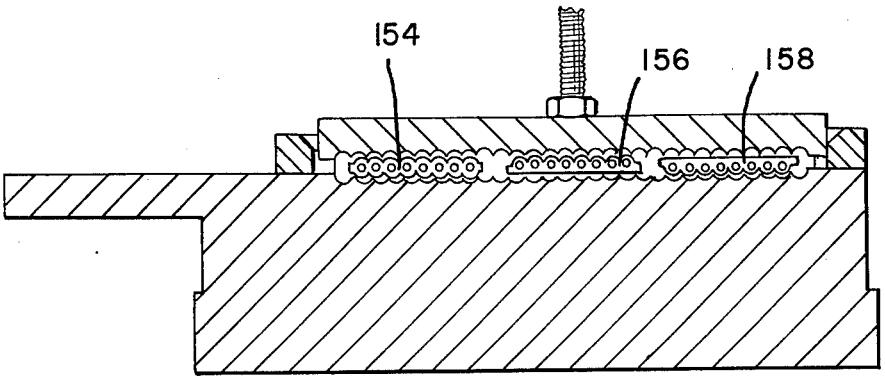
FIG. 15 is an end elevation of the base plate assembly of FIG. 14 with segments of three cable styles shown clamped therein.

The third embodiment of the subject base plate is shown in FIGS. 14 and 15 is distinguished from the previous two embodiments in several aspects. The third embodiment has a sliding base member 36 with a fluted base plate 38 secured thereto. This embodiment has a two step cable clamp 128 which is somewhat different from the previously described cable clamp assembly 60. This clamp is shown positioned immediately adjacent the crimp insert assembly 66 and includes a fluted pad 130 and a clamp toggle assembly 132 for moving the clamp pad 130 with respect to the base plate 38. Both the clamp pad 130 and the base plate 38 have a plurality of parallel flutes 134, 40, respectively, so that the base plate 38 and the pad 130 define therebetween a series of substantially cylindrical channels best seen in FIG. 15. It is also foreseen that a portion of the fluted face of pad 130 may be replaced by a spring biased plate (not shown) which will aid in initially holding the cable in place before final clamping. The base plate is also provided with a pair of spaced fixed guides 136, 138 each having a pad alignment notch 140, 142 which assure the correct alignment of the pad 130 with respect to the base plate 38. Guide 136 also has a connector receiving recess 144 aligned with one end of the crimp insert assembly 66. An adjustable connector guide member 146 is aligned with the other end of the crimp insert assembly 66 and is provided with a similar recess 148. Guide member 146 is arranged to slide in groove 150 and be adjustably secured to base plate 38 by securing means 152. A cable stop 153 is also secured to the end of the base plate 38.

FIG. 15 shows how the flutes of the base plate and the pad would be used to center various styles of cable. The cable 154 has a series of grooves formed between each of the conductors so that each conductor would positively lie in between the flutes 134, 40 in the pad 130 and the base plate 38, respectively. The cable 56 is flat on one surface which is shown laying against the base plate 38. The flutes 134 of the pad 130 will still engage in the grooves in the cable to properly align the cable. The cable 158 is similar to the cable 156 but is shown in the inverse position with the flat side against the pad 130. The use of the flutes 40, 134 on the base plate 38 and the pad 130 has the advantage of eliminating reliance on the marginal portion of the cable for alignment purposes. Guiding the cable from the side marginal edges can result in some lateral shift due to inaccuracies in manufacturing of the cable. Instead of working on the edge of the cable for alignment, the third embodiment utilizes the conductors themselves to center and align the cable. Thus there will be no need to compensate for manufacturing tolerances of the side marginal edge of the cable.

The third embodiment of the subject base plate assembly is used in a slightly different fashion from the other embodiments. The clamp 128 is either released to raise the pad 130 sufficiently to enable a cable 154, 156, 158 to be passed between the pad 130 and the base plate 38 or the clamp is opened wide. The cable is inserted and abutted against a cable stop (not shown) and the clamp 128 actuated to secure the cable to the base plate. The application of a connector to the cable then takes place in the manner previously described. After the connector 102 has been applied to the cable, the clamp 128 is raised fully to release the cable for inspection of the contacts and inversion for assembly with the connector housing cover.

Figure 16:
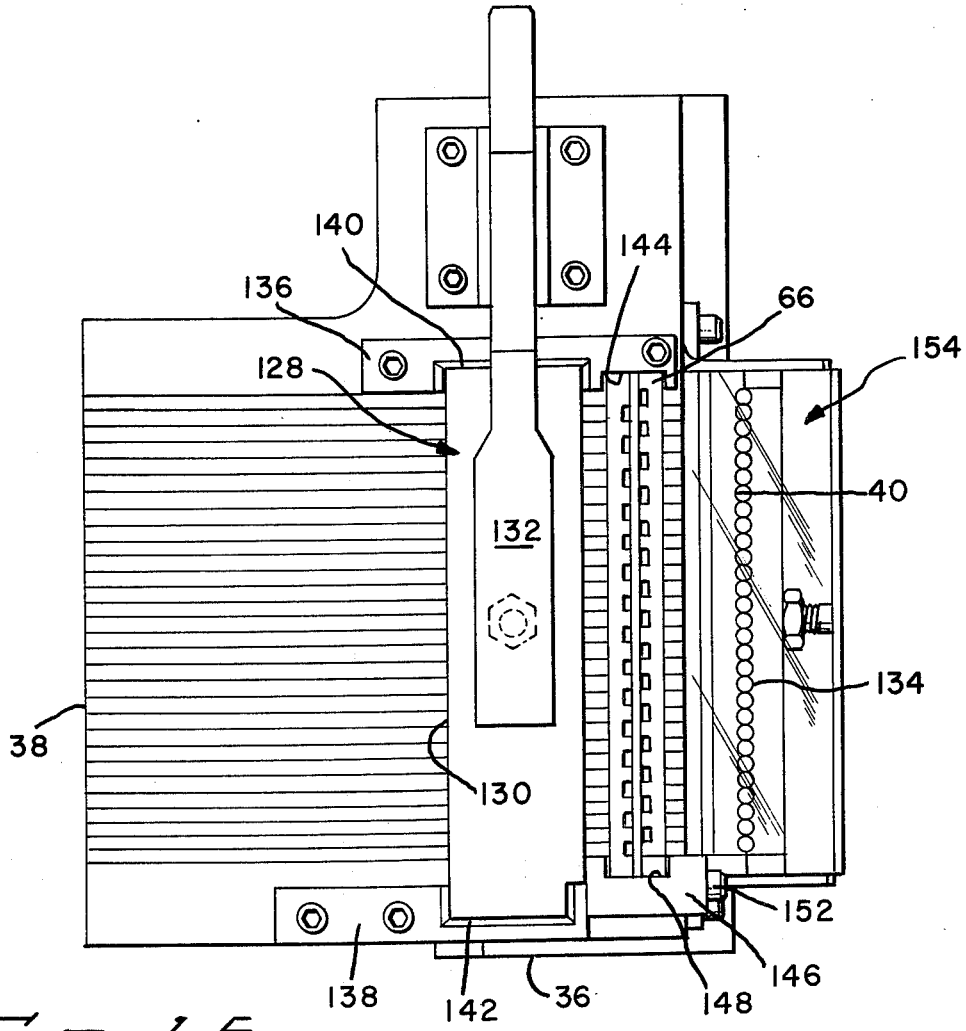
FIG. 16 is a plan view of a fourth embodiment of the base plate assembly for use in the subject invention.
Figure 17:
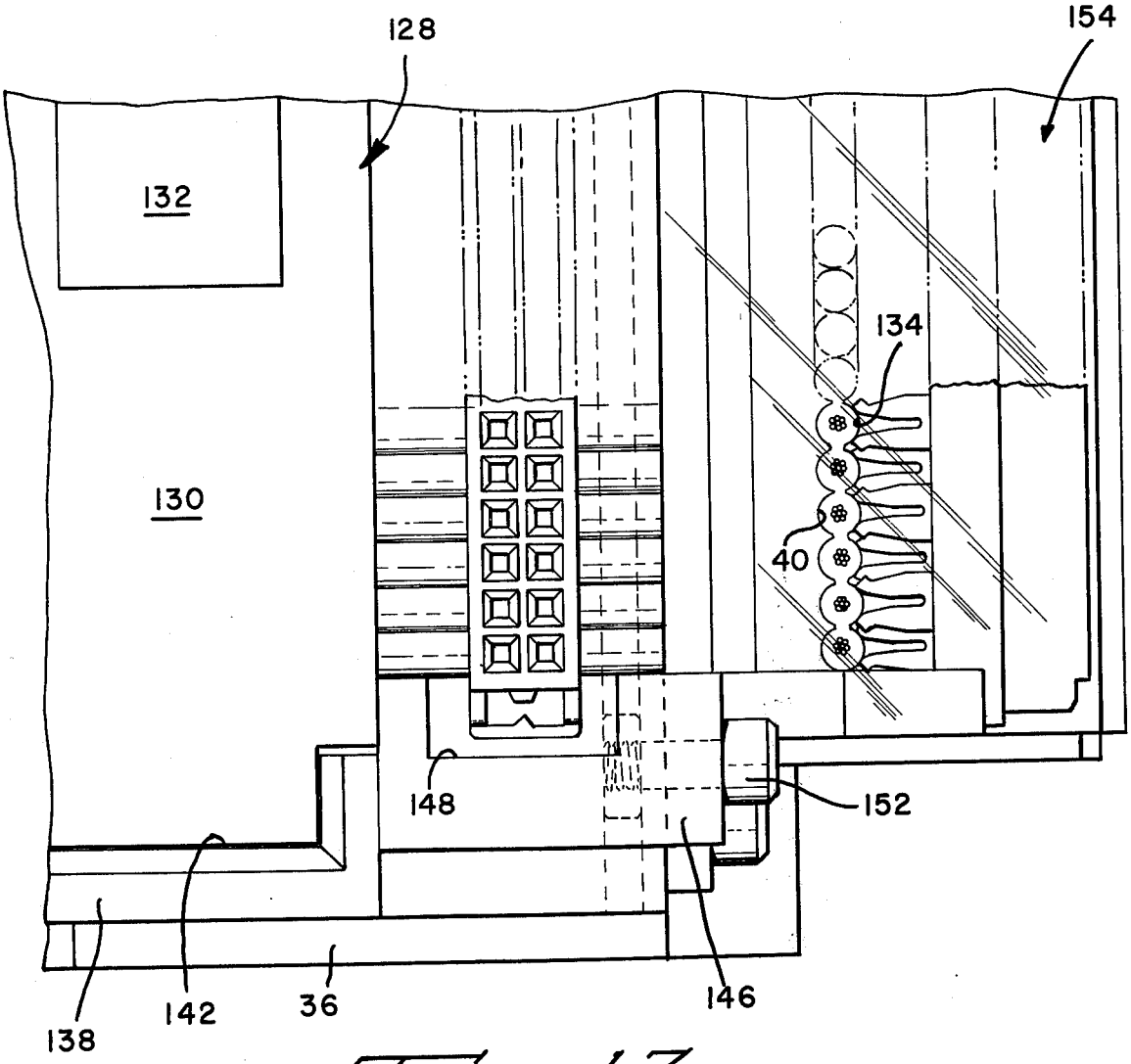
FIG. 17 is a detail view of one end of the embodiment of FIG. 16 showing a connector correctly located and ready for insertion into the clamped cable.

A modification of the third embodiment forms a fourth embodiment of the subject invention and is shown in FIGS. 16 and 17. This embodiment is distinguished from the previous embodiments primarily by the fact that it relies more heavily on the operator's visual and tactile senses to assure correct positioning of the connector. This embodiment has a sliding base member 36 with a fluted base plate 38 secured thereto. Positioned immediately adjacent the crimp insert assembly 66 is a two-step cable clamp 128 which includes a fluted pad 130 and a clamp toggle assembly 132 for moving the clamp pad 130 with respect to the base plate 38. Both the clamp pad 130 and the base plate 38 have a plurality of parallel flutes 134, 40, respectively, so that the base plate 38 and the pad 130 define therebetween a series of substantially cylindrical channels. It is also foreseen that the fluted face of pad 130 or a portion thereof may be replaced by a spring biased plate (not shown) which will aid in initially holding the cable in place before final clamping. The base plate is also provided with a pair of spaced fixed guides 136, 138 each having a pad stop notch 140, 142 which are spaced apart a greater distance than the length of the pad 130 with respect to the base plate 38. Guide 136 also has a connector receiving recess 144 aligned with one end of the crimp insert assembly 66. An adjustable connector guide member 146 is aligned with the other end of the crimp insert assembly 66 and is provided with a similar recess 148. Guide member 146 is arranged to slide in groove 150 and be adjustably secured to base plate 38 by securing means 152. An optical inspection assembly 154 is mounted at the end of the base plate, by means not shown, and comprises either a reflective surface, such as a mirror, or optical means, such as lenses, prisms, optical fibers, etc. which allows viewing along the surface of the base plate 38. The optical inspection assembly shown is a mirror which can be either fixedly or adjustably mounted and is preferably inclined approximately 45° with respect to the base plate so that the operator can view along the base plate by merely glancing in the mirror. The illustrated mirror also shows the flutes 40, 134 forming the previously mentioned cylindrical channels.

It was previously mentioned that cables of the type discussed suffer from having a rather wide range of manufacturing defects including either or both unevenness in cable edges and lack of uniformity in conductor spacing. This is one reason why it is not desirable to use either or both edges of the cable for alignment purposes and the primary reason why the present invention has adopted the use of fluted plates and relies on alignment of the conductors. However, there are often instances when the cable, or the section of the cable to be terminated, is unusable because of a variation in the spacing of the individual conductors. The fourth embodiment of the tool compensates for such cable defects by providing means whereby the operator can visually inspect the spacing of the conductors of the cable and their alignment with the contacts before termination is effected. The operator also tactically senses, as well as visually inspects, when the contacts of the connector are correctly aligned with the conductors of the cable.

In this fourth embodiment, the guide member 146 is secured a distance from guide 136 which is greater than the length of the connector to be joined with the cable and allows the connector to be moved transversely with respect to the cable less than half the distance between conductors. The cable is clamped to the base plate 38 by clamp 128 in the manner previously described. The connector is then introduced to the area defined by guides 136, 146 and moved until the tines of the contacts rest on the opposite sides of the respective conductors. This movement produces a definite seating motion which can be readily sensed by the operator. The operator, at the same time, can see that the contacts are properly aligned with the respective conductors as shown in FIG. 17. If a single or only a few conductors are not properly spaced, this may not be detected by the operator while laterally moving the connector. There, in fact, still may be the feeling of a seating motion if only a small number of the conductors are misaligned. However, the optical inspection assembly allows visual inspection to assure correct alignment and thus results in substantial economics since the instance of improper connections is significantly reduced.

The above described embodiments of the present invention are intended in all respects as being illustrative and not restrictive of the scope of the invention. The present invention may be subjected to many changes and modifications without departing from the spirit or essential characteristics thereof.

What is claimed is:

1. An applicator tool for applying an electrical connector onto a flat multi-conductor cable, said tool comprising:

a frame having integral, spaced, upper and lower arms, ram means mounted in said upper arm for vertical movement, an upper tooling member mounted on a free lower end of said ram means, means to actuate said ram means, guide rail means mounted on said lower arm extending from a point beneath said ram means in cantilever fashion, a lower tooling assembly including a sliding base mounted in said guide rail means for sliding motion between a point remote from said ram to said point beneath said ram, a base plate assembly fixed to said sliding base and including a base plate, cable guide means, cable clamp means for securing a cable to said base plate, crimping insert means for receiving and guiding contact arms of the connector applied by said tool and for ejecting the contacts when application is completed, and connector guide means aligned with opposite ends of said crimping insert means.

2. An applicator tool according to claim 1 wherein: said frame is substantially C-shaped for mounting on a bench or the like.

3. An applicator tool according to claim 1 wherein: said means to actuate said ram means is manually operated.

4. An applicator tool according to claim 1 wherein: said means to actuate said ram means includes a fluid operated drive motor.

5. An applicator tool according to claim 1 wherein said cable guide means comprises:

first and second cable guide members, means securing said first cable guide member to one side edge of said base plate assembly;

means adjustably securing said second cable guide member to said base plate assembly in parallel spaced relation to said first cable guide means.

6. An applicator tool according to claim 5 wherein said means adjustably securing said second cable guide member includes:

a slot in said base plate extending normal to said fixed first cable guide means, a groove spaced from and parallel to said slot, a projection integral with said second cable guide means and lying in said groove, and fastening means extending through said second cable guide member and said slot in said base plate whereby said second cable guide means is adjustably secured to said base plate.

7. An applicator tool according to claim 1 wherein: said base plate has a plurality of parallel flutes in an upper surface thereof, said base plate being secured to said sliding base with said flutes extending normal to the direction of said sliding motion.

8. An applicator tool according to claim 1 wherein said cable clamp means comprises:

a pad member, and a toggle assembly attached to said pad member and said base plate for moving said pad member with respect to said base plate whereby a cable is clamped between said pad member and said base plate.

9. an applicator tool according to claim 8 wherein said cable guide means comprises:

a plurality of parallel flutes in an upper surface of said base plate, and a like plurality of parallel flutes in said pad member whereby said base plate and said pad member define therebetween a plurality of channels for gripping individual insulated conductors forming the flat multi-conductor cable.

10. An applicator tool according to claim 9 further comprising:

pad guide means fixed to said base plate for aligning the flutes of said pad member with the corresponding flutes of said base plate member.

11. An applicator tool according to claim 1 further comprising cable stop means removably attached to one end of said base plate.

12. An applicator tool according to claim 1 further comprising:

first and second comb means fixed on opposite sides of said crimping insert means in parallel spaced relation whereby said flat multi-conductor cable can be fabricated of discrete insulated conductors laced through said comb means.

13. An applicator tool according to claim 12 further comprising:

means to sever said insulated conductors adjacent one of said comb members.

14. An applicator tool according to claim 13 wherein said means to sever said insulated conductors comprises:

a housing secured to one side edge of said base plate;

a groove in said base plate adjacent said one comb member; and blade means pivotally mounted on said housing for movement into said groove whereby said insulated conductors are severed.

15. An applicator tool according to claim 1 wherein said crimping insert means comprises:

at least one crimping member defining a plurality of contact receiving slots, a like number of stripper members each having a plurality of parallel spaced stripper blades adapted to lie in at least some of said contact receiving slots, and spring means biasing said stripper members to lie with the blades thereof in said contact receiving slots whereby upon release of applicating force by said ram said stripper blades will push the connector contacts from their respective contact receiving slots.

16. An applicator tool according to claim 15 wherein said contact receiving slots are profiled to prevent spreading of leg portions of contacts received therein.

17. An applicator tool according to claim 1 wherein said upper tooling member has a profile mating with the profile of the connector being applied by said tool.

18. An applicator tool according to claim 1 further comprising:

optical inspection means mounted adjacent said base plate for viewing along the surface thereof whereby spacing of the cable conductors and their alignment of the contacts is visually determined.

19. An applicator tool according to claim 18 wherein said optical inspection means comprises a reflective surface.

20. An applicator tool according to claim 18 wherein said optical inspection means comprises a prismatic assembly.

21. An applicator tool for applying to a flat multi-conductor cable an electrical connector having a housing with a plurality of electrical contacts fixed therein, said contacts including an insulation displacing portion for engaging the conductors of said cable, said tool comprising:

a substantially C-shaped frame having integral, spaced, upper and lower arms for mounting on a bench or the like;

ram means mounted in said upper arm for vertical movement;

an upper tooling member mounted on a free lower end of said ram means, said upper tooling member having a profile matable with the profile of said electrical connector;

means to actuate said ram means;

guide rail means mounted on said lower arm of said frame to extend from a point below said ram means in cantilever fashion, a lower tooling assembly including a sliding base mounted in said guide rail means for sliding motion between a point remote from said ram to said point beneath said ram, a base plate assembly fixed to said sliding base and including a base plate having a plurality of flutes in an upper surface thereof extending normal to the direction of said sliding movement, first and second cable guide means, means fixing said first cable guide means on one side of said fluted base plate, means adjustably securing said second cable guide means on said fluted base plate in parallel spaced relation from said fixed first cable guide means, cable end stop means detachably mounted on one end of said fluted base plate, cable clamp means including a pad and a toggle mechanism attached to said pad and said fluted base plate, said cable clamp means for clamping a cable between said pad and said fluted base plate, crimping insert means in said fluted base plate for receiving and guiding arm portions of the contacts in the connector applied by said tool and for ejecting the contacts when application is completed, and connector guide means aligned with opposite ends of said crimping insert means.

22. An applicator tool for applying to a flat multi-conductor cable an electrical connector having a housing with a plurality of electrical contacts fixed therein, said contacts including an insulation displacing portion for engaging the conductors of said cable, said cable being formed by a plurality of discrete insulated conductors, said tool comprising:

a substantially C-shaped frame having integral, spaced, upper and lower arms, and adapted to be mounted on a bench or the like;

ram means mounted in said upper arm for vertical movement;

an upper tooling member mounted on a free lower end of said ram means, said upper tooling member having a profile matable with the profile of said electrical connector;

means to actuate said ram means;

guide rail means mounted on said lower arm of said frame to extend from a point below said ram means in cantilever fashion, a lower tooling assembly including a sliding base mounted in said guide rail means for sliding motion between a point remote from said ram to said point beneath said ram, a base plate assembly fixed to said sliding base and including a base plate, first and second cable guide means, means fixing said first cable guide means on one side of base plate, means adjustably securing said second cable guide means on said base plate in parallel spaced relation from said fixed first cable guide means, cable end stop means detachably mounted on one end of said base plate, cable clamp means including a pad and a toggle mechanism attached to said pad and said base plate, said cable clamp means for clamping a cable between said pad and said base plate, crimping insert means in said base plate for receiving and guiding arm portions of the contacts in the connector applied by said tool and for ejecting the contacts when application is completed, connector guide means aligned with opposite ends of said crimping insert means, first and second comb means secured in parallel spaced relation on opposite sides of said crimping insert means whereby the discrete conductors forming said flat cable are laced through said comb members and are aligned thereby with the respective contacts of the connector, and means to sever said insulated conductors adjacent one of said combs.

23. An applicator tool for applying to a flat multiconductor cable an electrical connector having a housing with a plurality of electrical contacts fixed therein, said contacts including an insulation displacing portion for engaging the conductors of said cable, said tool comprising:

a substantially C-shaped frame having integral, spaced, upper and lower arms for mounting on a bench or the like;

ram means mounted in said upper arm for vertical movement;

an upper tooling member mounted on a free lower end of said ram means, said upper tooling member having a profile mating with the profile of said electrical connector;

means to actuate said ram means;

guide rail means mounted on said lower arm of said frame to extend from a point below said ram means in cantilever fashion, a lower tooling assembly including a sliding base mounted in said guide rail means for sliding motion between a point remote from said ram to said point beneath said ram, a base plate assembly fixed to said sliding base and including a base plate having a plurality of flutes in an upper surface thereof extending normal to the direction of said sliding movement, cable end stop means detachably mounted on one end of said fluted base plate, crimping insert means in said fluted base plate for receiving and guiding arm portions of the contacts in the connector applied by said tool and for ejecting the contacts when application is completed, connector guide means aligned with opposite ends of said crimping insert means, cable clamp means including a pad having a plurality of flutes in a bottom surface thereof and a toggle mechanism attached to said fluted pad and said fluted base plate, and pad guide means fixed to said fluted base plate, said cable clamp means for clamping a cable between said fluted pad and said fluted base plate whereby the conductors of said cable are aligned by said flutes in the base plate and pad for engagement by the respective contacts of the connector.

24. An applicator tool for applying to a flat multiconductor cable an electrical connector having a housing with a plurality of electrical contacts fixed therein, said contacts including an insulation displacing portion for engaging the conductors of said cable, said tool comprising:

a substantially C-shaped frame having integral, spaced, upper and lower arms for mounting on a bench or the like;

ram means mounted in said upper arm for vertical movement;

an upper tooling member mounted on a free lower end of said ram means, said upper tooling member having a profile mating said the profile of said electrical connector;

means to actuate said ram means;

guide rail means mounted on said lower arm of said frame to extend from a point below said ram means in cantilever fashion, a lower tooling assembly including a sliding base mounted in said guide rail means for sliding motion between a point remote from said ram to said point beneath said ram, a base plate assembly fixed to said sliding base and including a base plate having a plurality of flutes in an upper surface thereof extending normal to the direction of said sliding movement, cable end stop means detachably mounted on one end of said fluted base plate, optical inspection means attached to said one end of said base plate for viewing along the surface thereof in the direction of said flutes to visibly inspect the spacing of the conductors of the cable and their alignment with the contacts, crimping insert means in said fluted base plate for receiving and guiding arm portions of the contacts in the connector applied by said tool and for ejecting the contacts when application is completed, connector guide means aligned with opposite ends of said crimping insert means, cable clamp means including a pad having a plurality of flutes in a bottom surface thereof and a toggle mechanism attached to said fluted pad and said fluted base plate, and pad guide means fixed to said fluted base plate, said cable clamp means for clamping a cable between said fluted pad and said fluted base plate whereby the conductors of said cable are aligned by said flutes in the base plate and pad for engagement by the respective contacts of the connector.

* * * * *